US010507168B2

(12) United States Patent
Leung et al.

(10) Patent No.: US 10,507,168 B2
(45) Date of Patent: Dec. 17, 2019

(54) MUSICAL TEETHER

(71) Applicant: Kar Koi Leung, Kowleen (CN)

(72) Inventors: Kar Koi Leung, Hong Kong (CN); Elton Yu Man Leung, Hong Kong (CN)

(73) Assignee: KAR KOI LEUNG, Hong Kong (CN)

( * ) Notice: Subject to any disclaimer, the term of this patent is extended or adjusted under 35 U.S.C. 154(b) by 78 days.

(21) Appl. No.: 15/517,680

(22) PCT Filed: Oct. 17, 2014

(86) PCT No.: PCT/CN2014/088852
§ 371 (c)(1),
(2) Date: Apr. 7, 2017

(87) PCT Pub. No.: WO2016/058186
PCT Pub. Date: Apr. 21, 2016

(65) Prior Publication Data
US 2017/0304155 A1 Oct. 26, 2017

(51) Int. Cl.
*A61J 17/00* (2006.01)
*A61H 13/00* (2006.01)
(Continued)

(52) U.S. Cl.
CPC ..... *A61J 17/002* (2015.05); *A61H 13/00* (2013.01); *A61H 23/0236* (2013.01);
(Continued)

(58) Field of Classification Search
CPC ..... A61J 17/00; A61J 17/001; A61J 17/002; A61J 17/007; A61J 17/02
See application file for complete search history.

(56) References Cited

U.S. PATENT DOCUMENTS 4,554,919 A 11/1985 Hubert
4,726,376 A 2/1988 Dahan
(Continued)

FOREIGN PATENT DOCUMENTS

CN 2617357 Y 5/2004
CN 201200622 Y 3/2009
(Continued)

OTHER PUBLICATIONS

WO2009152727—International Search Report, dated Sep. 10, 2009, Greenbulb Trading Limited.
(Continued)

*Primary Examiner* — Todd J Scherbel
(74) *Attorney, Agent, or Firm* — Brian S. Boyer; Syndicated Law, PC

(57) ABSTRACT

The invention is concerned with a musical teether for infant. It has a body member including one or more regions or projections on which an infant can bite in use for soothing purpose and a musical unit. The body member is configured to receive or otherwise accommodate the musical unit which is removably engageable with the body member. The teether further has means for transmitting vibrational musical signal from the musical unit to the body member for onward transmission to teeth of the infant, then to jaw bones and skull of the infant, and then to ear bones of the infant, such that the infant can, while biting on the teeth, receive vibrational musical signal arisen from direct vibration on the ear bones of the infant.

18 Claims, 7 Drawing Sheets

(51) Int. Cl.
*A61J 17/02* (2006.01)
*A61H 23/02* (2006.01)

(52) U.S. Cl.
CPC ..... *A61J 17/02* (2013.01); *A61H 2201/0153* (2013.01); *A61H 2201/5007* (2013.01); *A61H 2201/5048* (2013.01); *A61H 2201/5097* (2013.01); *A61H 2205/026* (2013.01)

(56) References Cited

U.S. PATENT DOCUMENTS

| | | | | |
|---|---|---|---|---|
| 5,540,719 | A | 7/1996 | Covelli | |
| 5,662,685 | A | 9/1997 | Uhler | |
| 5,693,073 | A | 12/1997 | Glick | |
| 5,865,711 | A | 2/1999 | Chen | |
| 6,066,161 | A | 5/2000 | Parella | |
| 6,102,935 | A | 8/2000 | Harlan et al. | |
| 6,193,742 | B1 | 2/2001 | Moriarty | |
| 6,264,678 | B1 * | 7/2001 | Landers ..... | A61J 17/00 606/234 |
| 7,703,848 | B1 | 4/2010 | Cochran et al. | |
| 2004/0168565 | A1 | 9/2004 | Nagao et al. | |
| 2007/0230719 | A1 | 10/2007 | Filo et al. | |
| 2007/0265661 | A1 | 11/2007 | Coleman | |
| 2008/0197097 | A1 | 8/2008 | Montgomery | |
| 2011/0082501 | A1 * | 4/2011 | Leung ..... | A61J 17/002 606/234 |
| 2012/0302924 | A1 * | 11/2012 | Cunningham ..... | A61B 5/038 600/590 |

FOREIGN PATENT DOCUMENTS

| | | | |
|---|---|---|---|
| CN | 101951867 | A | 8/2009 |
| CN | 201890482 | U | 7/2011 |
| CN | 20194936 | U | 8/2011 |
| CN | 202143714 | U | 2/2012 |
| DE | 20303360 | U | 4/2003 |
| WO | WO2009152727 | | 12/2009 |

OTHER PUBLICATIONS

WO2016058186 International Search Report, dated Apr. 21, 2016, Leung.

* cited by examiner

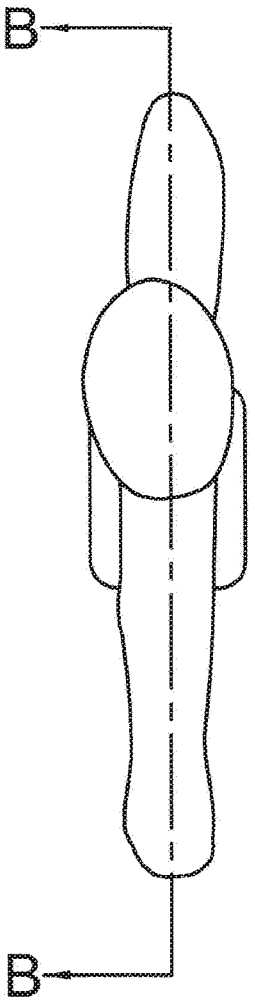
Fig. 12
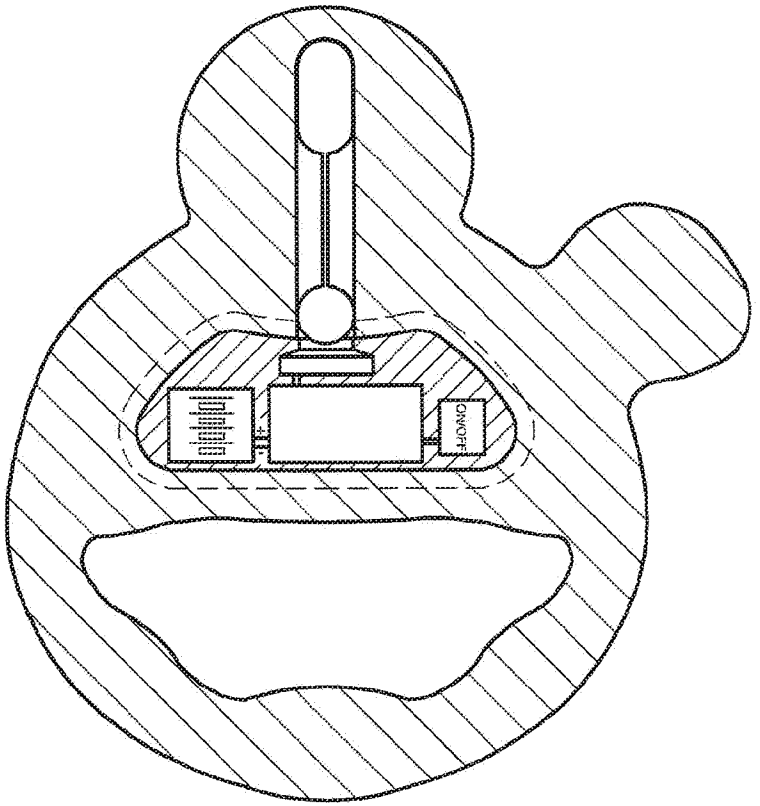
SECTION B-B Fig. 13

SECTION A-A

MUSICAL TEETHER

CROSS-REFERENCE TO RELATED APPLICATIONS

This application is a National Stage of International Application No. PCT/CN2014/088852, filed Oct. 17, 2014, which is incorporated herein by reference in its entirety.

FIELD OF THE PRESENT INVENTION

The present invention is concerned with a soothing tool for infant, and in particular but not limited to a musical teether for infant.

BACKGROUND OF THE PRESENT INVENTION

Teething is a natural process that occurs in an infant. During this process, teeth sequentially emerge through the gums. Teething may begin as early in three months of age and in some infants, it may take several years for typically all twenty teeth to emerge (i.e. until three to four years of age). Teething often cause pain or at least some level of discomfort to the infant. For this reason, infants during teething are often cranky. Crying, sleeplessness, restlessness and even mild fever are often associated with teething. Studies have shown that allowing an infant to chew or bite on an objection would relieve discomfort during teething. There are thus different conventional teethers in the market.

While conventional teethe is useful to some extent, it is monotonous in that after an infant has used it for a while, its effect in providing a soothing effect is less noticeable or sometimes it even becomes useless. For example, some infants despite being provided with a teether would still appear very cranky, and would cry or make noise. This often causes much confusion to the parents taking care of the infant, not knowing what the problem the infant is having, or whether the infant is having other problems. If the infant is crying in certain occasions, e.g. during a mass in a church, the crying of the infant would cause much disturbance and embarrassment.

The present invention seeks to address these problems, or at least to provide an alternative to the public.

SUMMARY OF THE PRESENT INVENTION

According to a first aspect of the present invention, there is provided a teether for infant comprising a body member including one or more regions or projections on which an infant can bite in use for soothing purpose and a musical unit, the body member is configured to receive or otherwise accommodate the musical unit, the musical unit being removably engageable with the body member, wherein the teether further comprises means for transmitting vibrational musical signal from the musical unit to the body member for onward transmission to teeth of the infant, then to jaw bones and skull of the infant, and then to ear bones of the infant, such that the infant can, while biting on the teeth, receive vibrational musical signal arisen from direct vibration on the ear bones of the infant.

Preferably, the teether may comprise an inner portion at which the body member receives or accommodates the musical unit. The teether may comprise an outer portion via which the vibrational musical signal is transmitted to the infant. The transmission means may include a conduit defined by the body member, the conduit connecting the inner portion and the outer portion, and the transmission means may further include a transmitter for transmitting the vibrational musical signal from the musical unit, wherein the transmitter is elongate in profile with enlarged opposite ends and is disposed in the conduit.

The transmitter may have a middle region narrower than the opposite ends such that the middle region is not in contact or is in minimal contact with walls defining the conduit of the teether. The transmitter may be made of a relatively stiff material selected from a group including a polymeric plastic(s) material and a metallic material. The musical unit may include a vibrational speaker disposed to directly or indirectly contact an inner end of the transmitter. The musical unit may include a musical circuitry, battery, a vibrational speaker disposed to contact an inner end of the transmitter and an on/off switch, the vibrational speaker configured to convert electronic signal to vibrational musical signal.

In an embodiment, the musical unit may include a built-in memory for storing musical files or data. The musical unit may include a receiver for receiving wireless musical signal for onward transmission.

The one or more regions or projections of the teether may be made of a relatively soft material selected from a group including natural rubber and silicone rubber.

According to a second aspect of the present invention, there is provided a teether for infant comprising a body member, a musical unit removably engageable with the body member and a transmitter for transmitting vibrational musical signal from the musical unit to the body member for onward transmission to teeth of the infant, wherein the transmitter is generally elongate in profile with enlarged opposite ends and narrower middle region, and is disposed in a conduit in the body member.

Preferably, the body member may include one or more regions or projections on which an infant can bite in use. The conduit defined by the body member may connect inner portion and outer portion of the body member. The middle region of the transmitter may not be in contact or may be in minimal contact with walls defining the conduit of the teether for facilitating transmission of vibrational musical signal. The transmitter may be made of a relatively stiff material selected from a group including a polymeric plastic(s) material and a metallic material. The musical unit may include a vibrational speaker disposed to directly or indirectly contact an inner end of the transmitter, the vibrational speaker configured to convert electronic signal to vibrational musical signal. The musical unit includes a musical circuitry, battery, a vibrational speaker disposed to directly or indirectly contact an inner end of the transmitter and an on/off switch, the vibrational speaker configured to convert electronic signal to vibrational musical signal. The musical unit may include a built-in memory for storing musical files or data.

In an embodiment, the musical unit may include a receiver for receiving wireless musical signal for onward transmission. The one or more regions or projections of the teether may be made of a relatively soft material selected from a group including natural rubber and silicone rubber.

In one embodiment, the teether may be configured to allow vibrational musical signal be transmitted from the body member to teeth of the infant, then to jaw bones and skull of the infant, and then to ear bones of the infant, such that the infant can, while biting on the teeth, hear music arisen from direct vibration on the ear bones.

BRIEF DESCRIPTION OF DRAWINGS

Some embodiments of the present invention will now be explained, with reference to the accompanied drawings, in which:—

FIG. 12 is a side view of the teether shown in FIG. 2;

FIG. 13 is a cross section view of the teeth of FIG. 11, taken along B-B';

PREFERRED EMBODIMENTS OF THE PRESENT INVENTION

The present invention is concerned a tool for use in infant in providing a soothing or comforting sensation to the infant. While the tool is particularly suitably for use in teething infants, they can also useful in toddlers or early age children regardless of their teething conditions.

Figure 1:
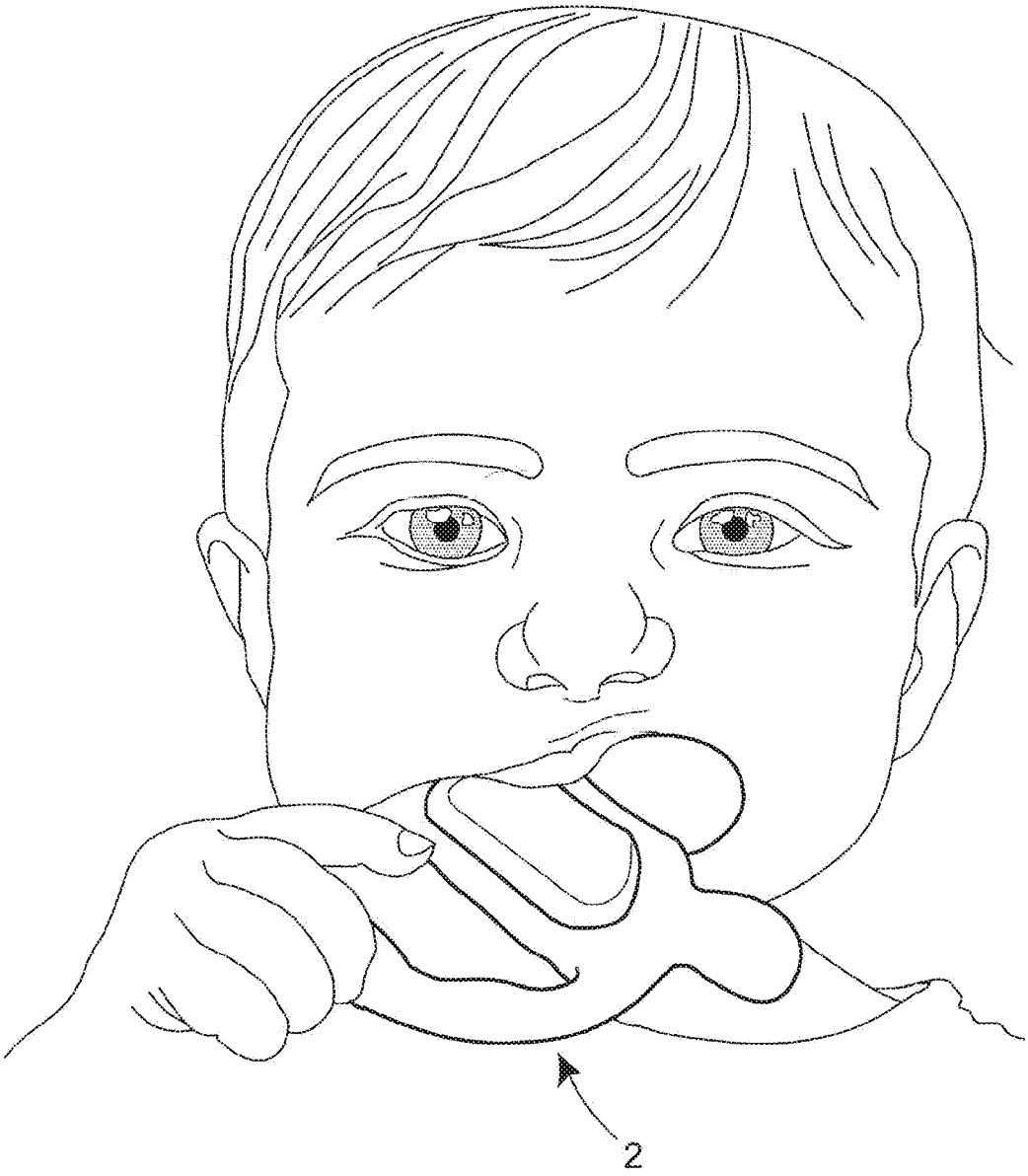
FIG. 1 is a schematic diagram showing an infant holding on to an embodiment of a teether of the present invention.
Figure 2:
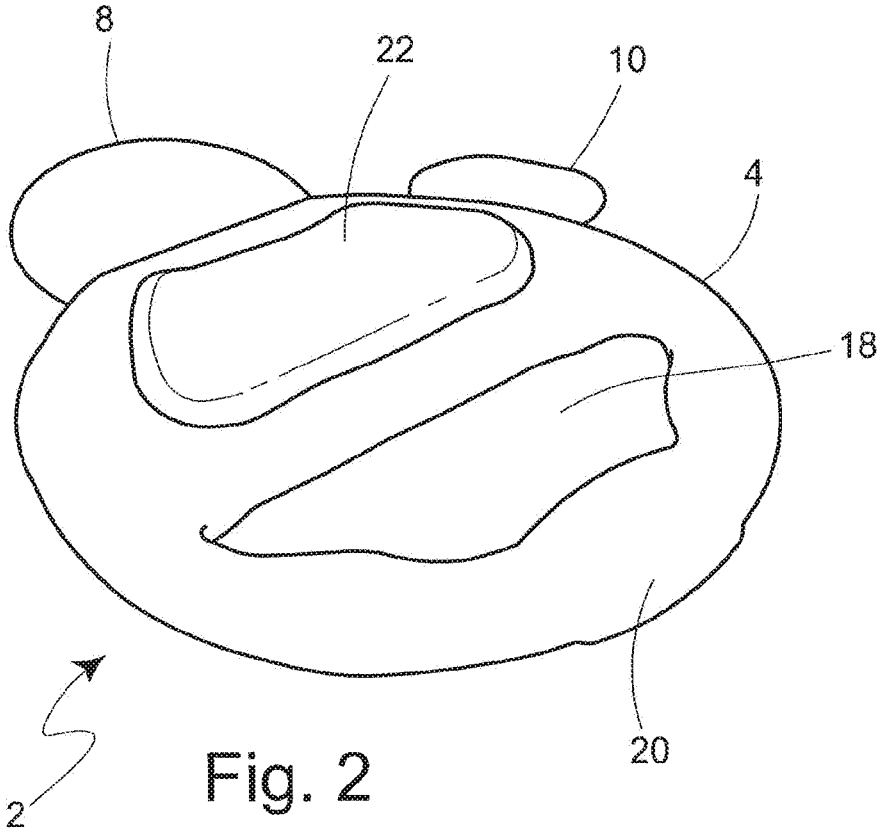
FIGS. 2 and 4 show a perspective view of the teether in FIG. 1.
Figure 3:
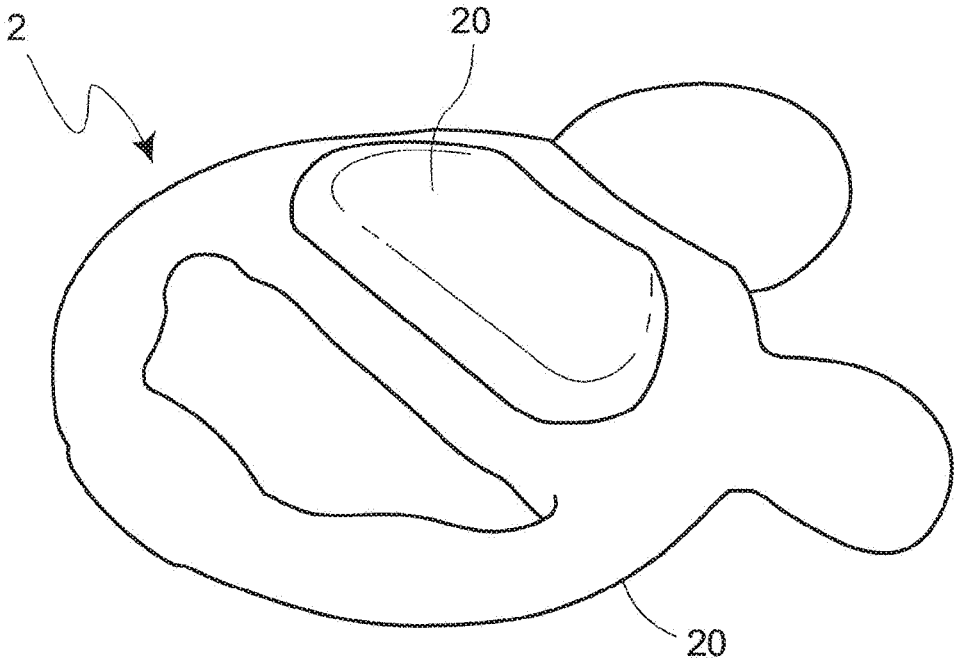
FIG. 3 is an alternative perspective view of the teether in FIG. 1.

FIG. 1 is a schematic diagram showing an infant holding on to an embodiment of a soothing tool 2, or alternatively called teether. FIG. 2 and FIG. 3 show two different perspective views of the teether of FIG. 1. The teether 2 has a main body member 4 is generally flat, or otherwise thin and broad construction. The main body member 4 has in this embodiment has a substantially circular profile. The teether 2 has two round projections 8, 10 protruding from a side of the main body member 4. While the projections of the teethers 2 have a relatively smooth surface, in alternative embodiments, structures or textures in the form of juts and ridges may be provided to the projections for enhancing the surface of the projections.

The main body member 4 has a circumferential ring structure defining a first cavity 18. The ring structure is provided at one portion with roughened surface 20. In use, an infant can hold on to or handle the teether 2 at the roughened surface 20 which allow an improved frictional grip by the fingers via the first cavity 18. Although not shown in this embodiments, juts and ridge as described above may be provided adjacent the ribs 20 for enhancing grip by the infant, or to provide a further rugged regions at which the infant can bite on for relieving tension.

The main body member 4 is made of essentially a (relatively soft) polymer material suitable for infants to bite on, and is "food safe". For example, the material may essentially be a silicone material or natural rubber material which is relatively inert and safe for oral contact.

Figure 4:
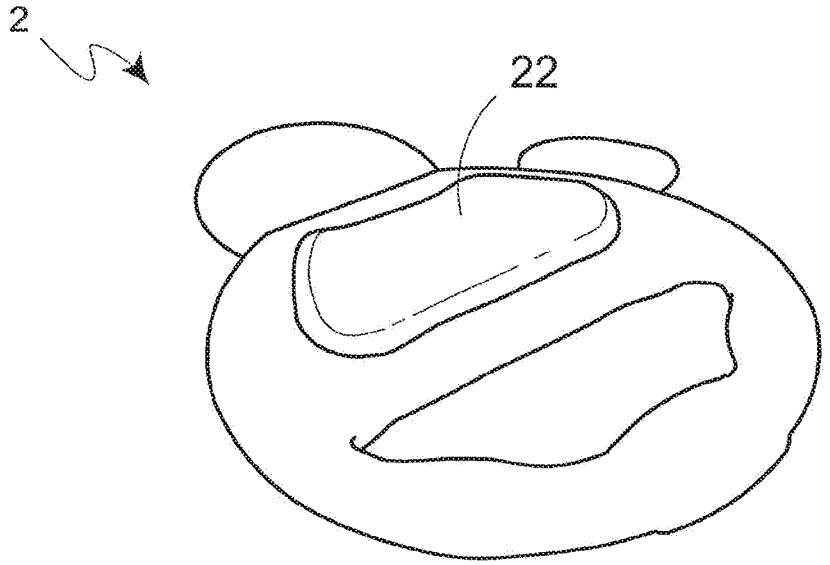
Figure 5:
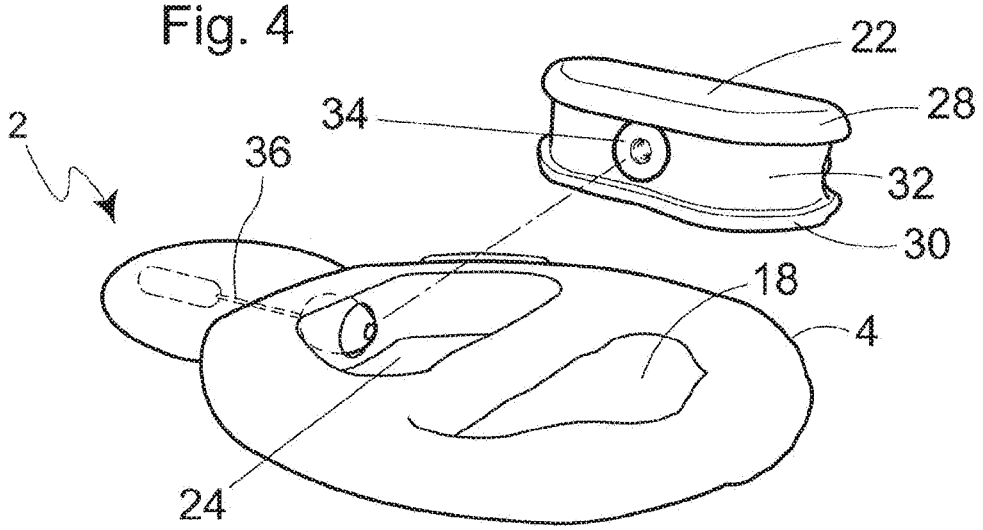
FIG. 5 show the teether in FIGS. 2 and 4, with a middle member, or a musical unit, being disengaged from the rest of the teether.

FIG. 4 shows the teether 2 in a configuration assembled with a musical unit 22. FIG. 5 shows the ring structure of the body member 4 defining a second cavity 24 in an inner portion in which the musical unit 22 is receivable. By inner portion, it refers to the location of the second cavity away from circumferential or end regions of the teether, or at or close to a central region the teether, such that in use an infant would not be able to bite on this portion. A connecting bridge 26 is disposed across the ring member, the bridge 26 separating the first cavity 18 and the second cavity 24. The musical unit 22 is removably engeagble in the second cavity 24. The second cavity 24 is sized and shaped to allow the musical unit 22 to fit tightly therein. The musical unit 22 has electronic components therein, while the rest of the teether 2, i.e. the ring structure, is free of electronic components or other washable. In fact, after the teether has been used it can be washed and disinfected, e.g. in a dish washer or sterilizer.

In particular, in this embodiment the musical unit 22 has upper flange 28 and a lower flange laterally extending thereof, and narrower middle portion 32. The musical unit 22 is dimensioned such that when assembled in the second cavity 24 surrounding region of the ring structure tightly fits around the narrower middle portion 32 and sandwiched by the upper and lower flanges 28, 30. The extent of tightness is such that the infant or child would have not sufficient strength to remove the musical unit 22 from the ring structure intentionally or accidentally, and only an adult would have sufficient physical strength to separate the ring structure and the musical unit 22, e.g. for cleaning. Please also see FIG. 5.

The electronic components in the musical unit 22 include a vibrational music circuitry, a vibrational speaker 34 for outputting vibrational music signal, a battery and a power switch. In one embodiment, the vibrational music circuitry is provided with a memory unit for storing music files or data and a controller for determining which music file to play. When a music file is played, the vibrational music circuitry sends corresponding electronic signal to the vibrational speaker 34 for outputting corresponding vibrational music signal for onward transmission. It is to be noted that during the sending of the electronic signal and the outputting of the vibrational music signal, no audio sound is generated. In other words, no sound can be heard in the surroundings.

Figure 6:
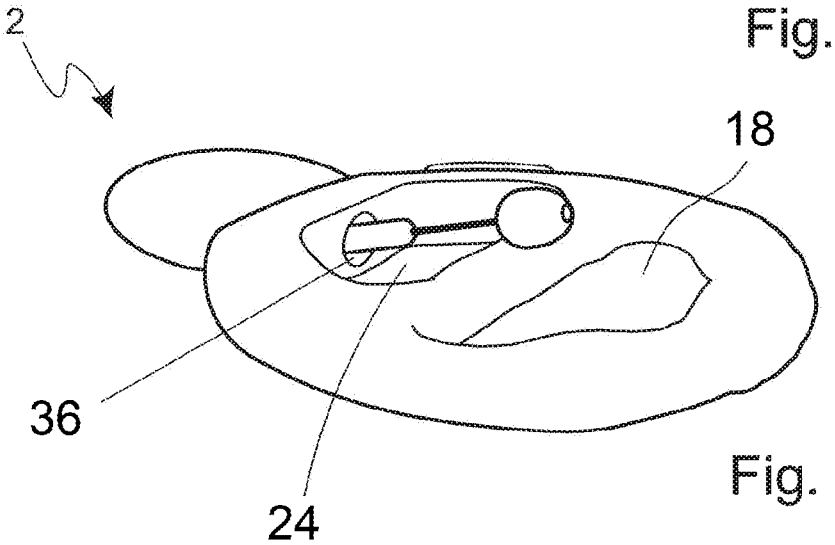
FIG. 6 shows the teether of FIG. 5 but with the middle member removed, and showing a transmitter.
Figure 7:
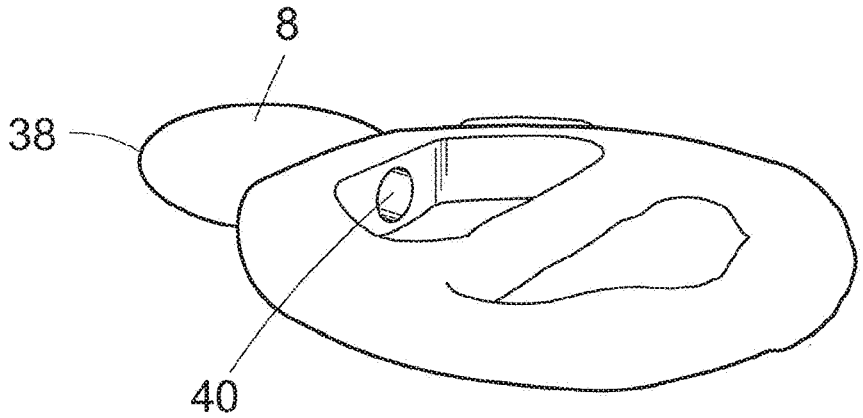
FIG. 7 shows the teether of FIG. 6, but without the transmitter.

Referring to FIGS. 5-6, the body member 4 is provided with means for the onward transmission of the vibrational music signal. The transmission means includes a conduit or channel 36 defined by surrounding structure of the body member 4. The conduit 36 is elongate in shape and extends from one end of the ring structure through one of the projections 8. In other words, the conduit 36 connects the ring structure to a far end or outer portion 38 of the projection 8. By far end or outer portion, it refers to the location of the outer portion at a circumferential region or a distal region of the teeth, such that in use an infant would bite on this portion. On the other end of the ring structure, there is provided an opening 40 while the far end 38 of the projection 8 is closed, and the surface of the projection 8 at the far end is provided with the two juts and ridge described above. Please see FIG. 7-8.

Figure 8:
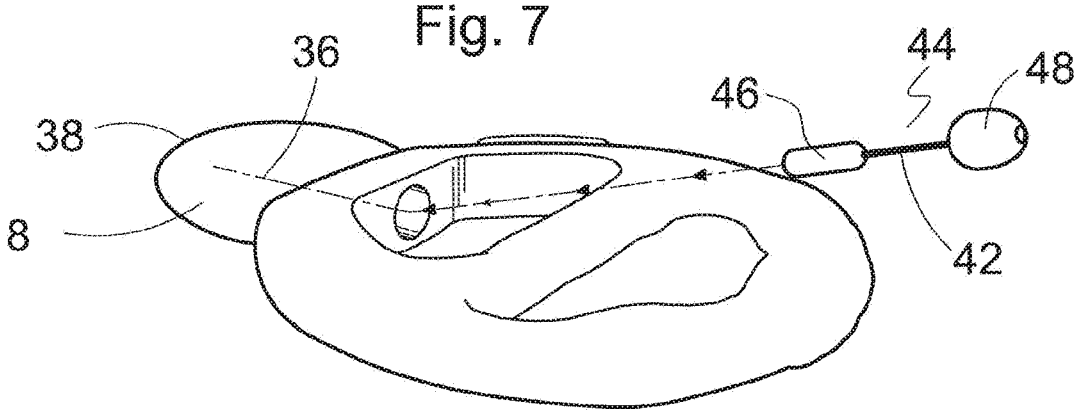
FIG. 8 shows the teether of FIG. 7, and FIG. 8 together with FIG. 5 illustrate disposition of the transmitter in the teether when assembled.
Figure 9:
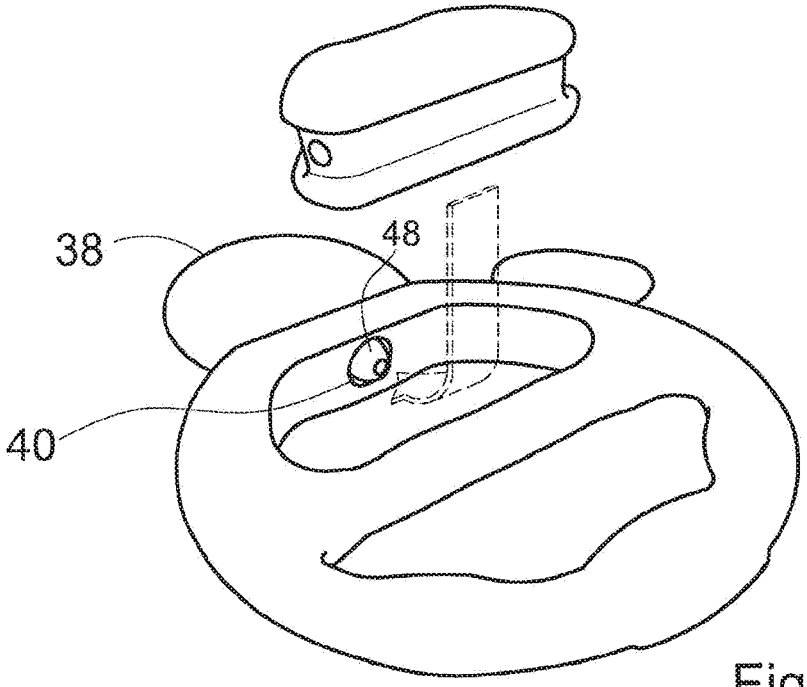
FIG. 9 is an alternative perspective view of the teether, illustrating the middle member being engaging with the teether.
Figures 10, 11:
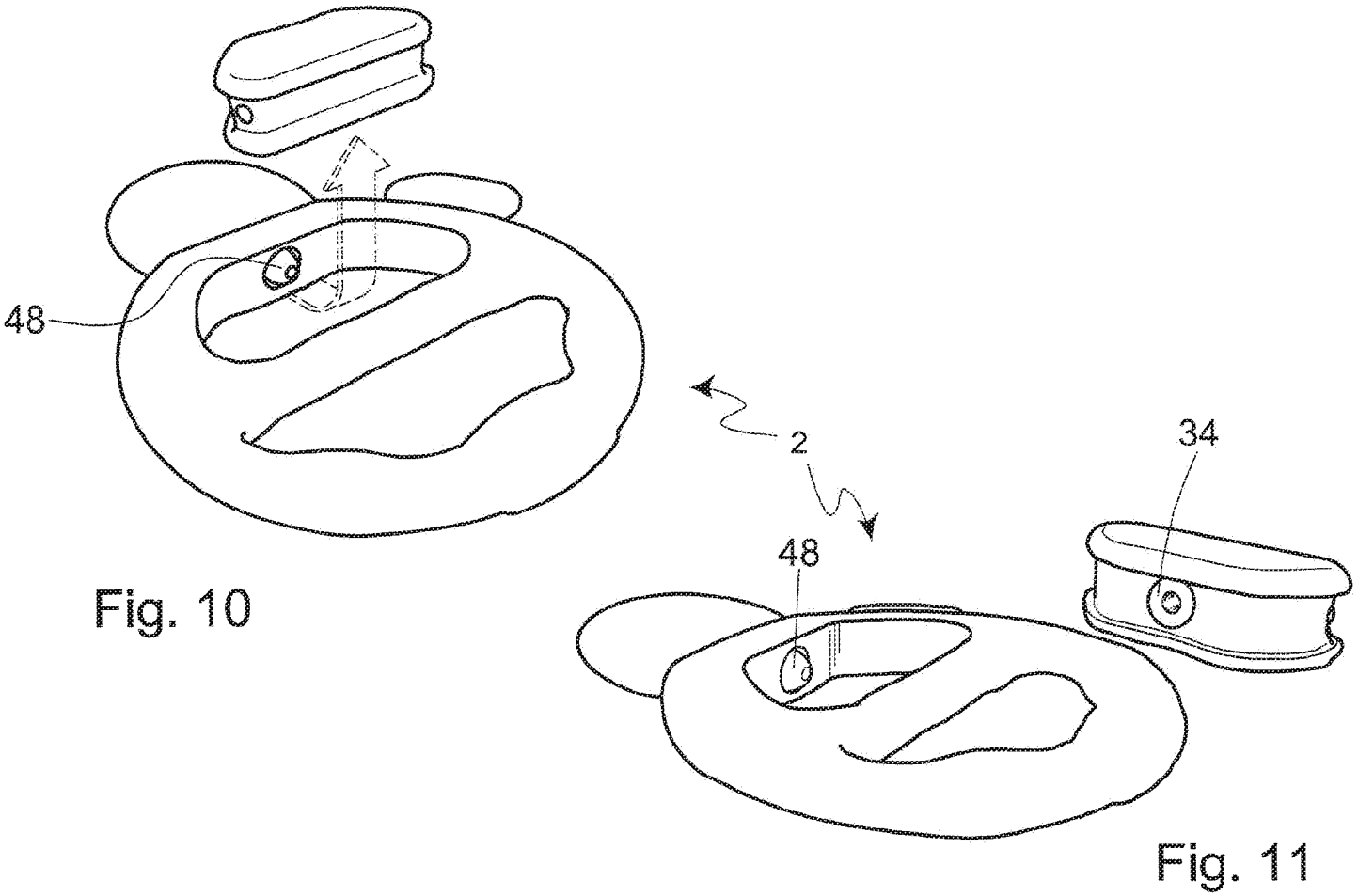
FIG. 10 corresponds to FIG. 9, with the middle member being disengaged.
FIG. 11 corresponds to FIG. 10, with the middle member disengaged.
Figure 14:
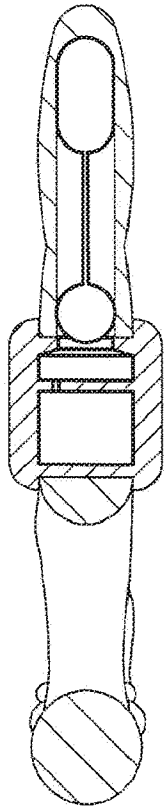
FIG. 14 is a top view of the teeth of FIG. 2.
Figure 15:
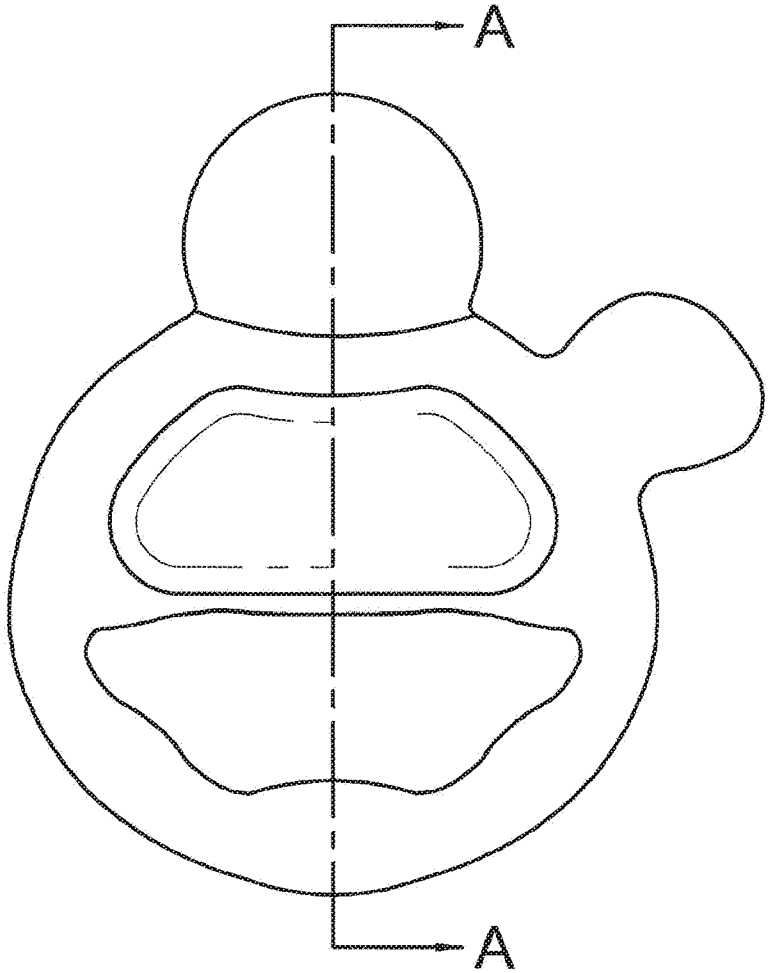
FIG. 15 is a cross section view of the teeth of FIG. 13, taken along A-A'.

Referring to FIGS. 8-9, the transmission means includes a transmission member 42 disposed in the conduit. The transmission member 42 has an elongate profile with a narrower middle portion 44 and enlarged opposite ends 46, 48. One of the enlarged opposite ends 46 is disposed next to and abuts the far end 38 of the projection 8 in the conduit 36 while the other opposite end 48 resides at the opening 40 of the conduit 36. The other opposite end 48 is relatively round in configuration and protrudes slightly from the opening 40 such that when assembled this round end 48 of the transmission member 42 abuts the vibrational speaker 34, for receiving vibrational music signal therefrom. The transmission member 42 is configured in this manner to allow transmission of vibrational music signal on one hand, and allow minimal mechanical contact between the transmission member 42 and the body member 4 on the other hand, thus to reduce excessive loss of vibrational signal during transmission.

It is thus to be understood that the transmission member 42 adopts bone-shaped configuration. The transmission member 42 is made of a material suitable for transmitting vibration, such as hard plastic(s) material or metallic material, and not (soft) polymeric material.

It is envisaged that vibrational music signal output from the vibrational speaker 34 is transmitted through the transmission member 42 in the conduit 36 to the projection 8. In use, when an infant is biting on the projection 8 to seek soothing comfort, the vibrational music signal is transmitted through the projection 8 to the (gum and the) teeth of the infant. The vibrational music signal is then further transmitted from the teeth (to the skull and then) to the ear bones of the infant. Although the music is transmitted in a vibrational manner and not in an audio manner, still the infant can "hear" or otherwise receive the music vibrationally, and thus can enjoy soothing music. This arrangement greatly and technically improves conventional teethers. Further, the use of teethers in accordance with the present invention would not generate audio sounds to the surroundings or disturb the surroundings which are particularly useful in quite occasions or premises. Please see FIGS. 10-14.

In the aforementioned embodiment, music files are pre-installed in the vibrationally music circuitry, and the infant can hear or receive the music vibrationally arising from these music files. In another embodiment, the music circuitry is provided with a memory adapted to receive further music files after manufacture. It is envisaged that a user, e.g. a parent, can select desired music files suitable for the particular infant and then download or save them in the memory. Accordingly, as the infant is growing up, e.g. through the teething age, s/he can receive or listen to different music vibrationally arising from these modified music file collection.

Yet in the aforementioned embodiment, the music files stored in the circuitry or memory are played sequentially according to sequential listing of the music files. In an alternative embodiment, the music unit is provided with control means for allowing user to determine whether the music files can be played sequentially or randomly or to play certain music files particular. The control means includes one or more bubble buttons via which selection is made.

In one of the aforementioned embodiments, the memory can be updated with new set of music files. In specific embodiments, the musical unit is configured with wire connection means to the circuitry and memory for updating the music file set. For example, the connection means may include a USB connection. Alternatively, the musical unit may include wireless connection means via which connection means via which music files can be transferred to the memory wirelessly.

In a specific embodiment, the teether is provided with a wireless controller configured to communicate with the musical unit. The teether is adapted to control on/off status of the musical unit, and playing mode of the musical unit. For example, when the infant is using the teether in an outdoor environment and the parent would like to interact with the infant while the infant is using the teether, the parent can turn off the musical unit wireless. If however the infant has entered a premises in which quietness is required, the parent can turn on the teether remotely, thus to provide additional soothing comfort via vibrational music without compromising the quietness.

It should be understood that certain features of the invention, which are, for clarity, described in the content of separate embodiments, may be provided in combination in a single embodiment. Conversely, various features of the invention which are, for brevity, described in the content of a single embodiment, may be provided separately or in any appropriate sub-combinations. It is to be noted that certain features of the embodiments are illustrated by way of non-limiting examples. Also, a skilled person in the art will be aware of the prior art which is not explained in the above for brevity purpose. Specifically, skilled person in the art is aware of working of conventional electronics and circuitry.

We claim:

1. A teether comprising a body member including one or more regions or projections on which an infant can bite in use for relieving discomfort during teething and a musical unit, the body member is configured to receive or otherwise accommodate the musical unit, the musical unit being removably engageable with the body member, wherein the teether further comprises a transmitter device for transmitting vibrational musical signal from the musical unit to the body member for onward transmission to teeth of the infant, then to jaw bones and skull of the infant, and then to ear bones of the infant, such that the infant can, while biting on the teether, receive vibrational musical signal arisen from direct vibration on the ear bones of the infant, wherein the teether further comprises an inner portion at which the body member receives or accommodates the musical unit and an outer portion via which the vibrational musical signal is transmitted to the infant, and wherein the transmitter device includes a conduit defined by the body member, the conduit connecting the inner portion and the outer portion, and the transmitter device further include a transmitter with opposite ends, the opposite ends in abutment with the musical unit and the outer portion, respectively, wherein the transmitter has a middle region narrower than the opposite ends such that only the opposite ends are in contact but the middle region is not in contact with the walls defining the conduit.

2. A teether as claimed in claim 1, wherein the opposite ends include a distal end and a proximal end, and wherein the proximal end is round in configuration for abutting the inner portion of the teether.

3. A teether as claimed in claim 1, wherein the transmitter is made of a relatively stiff material selected from a group including a polymeric plastic(s) material and a metallic material.

4. A teether as claimed in claim 1, wherein the musical unit includes a vibrational speaker disposed to directly or indirectly contact an inner end of the transmitter.

5. A teether as claimed in claim 1, wherein the musical unit includes a musical circuitry, battery, a vibrational speaker disposed to contact an inner end of the transmitter and an on/off switch, the vibrational speaker configured to convert electronic signal to vibrational musical signal.

6. A teether as claimed in claim 1, wherein the musical unit includes a built-in memory for storing musical files.

7. A teether as claimed in claim 1, wherein the musical unit includes a receiver for receiving wireless musical signal for onward transmission.

8. A teether as claimed in claim 1, wherein the one or more regions or projections are made of a relatively soft material selected from a group including natural rubber and silicone rubber.

9. A teether comprising a body member, a musical unit removably engageable with the body member and a transmitter for transmitting vibrational musical signal from the musical unit to the body member for onward transmission to teeth of the infant, wherein the transmitter is generally elongate in profile with enlarged opposite ends and narrower middle region, and is disposed in a conduit in the body member and is in abutment with the musical unit and the outer portion at the opposite ends, wherein the middle region of the transmitter is not in contact with walls defining the conduit of the teether for facilitating transmission of vibrational musical signal.

10. A teether as claimed in claim 9, wherein the body member includes one or more regions or projections on which an infant can bite in use.

11. A teether as claimed in claim 10, wherein the one or more regions or projections are made of a relatively soft material selected from a group including natural rubber and silicone rubber.

12. A teether as claimed in claim 9, wherein the conduit defined by the body member connects an inner portion and an outer portion of the body member.

13. A teether as claimed in claim 12, wherein the transmitter is made of a relatively stiff material selected from a group including a polymeric plastic(s) material and a metallic material.

14. A teether as claimed in claim 12, wherein the musical unit includes a vibrational speaker disposed to directly or indirectly contact an inner end of the transmitter, the vibrational speaker configured to convert electronic signal to vibrational musical signal.

15. A teether as claimed in claim 9, wherein the musical unit includes a musical circuitry, battery, a vibrational speaker disposed to directly or indirectly contact an inner end of the transmitter and an on/off switch, the vibrational speaker configured to convert electronic signal to vibrational musical signal.

16. A teether as claimed in claim 9, wherein the musical unit includes a built-in memory for storing musical files.

17. A teether as claimed in claim 9, wherein the musical unit includes a receiver for receiving wireless musical signal for onward transmission.

18. A teether as claimed in claim 9, configured to allow the vibrational musical signal to be transmitted from the body member to teeth of the infant, then to the jaw bones and the skull of the infant, and then to the ear bones of the infant, such that the infant can, while biting on the teether, hear music arising from direct vibration on the ear bones.

* * * * *